US009875836B2

(12) United States Patent
Raizer

(10) Patent No.: US 9,875,836 B2
(45) Date of Patent: Jan. 23, 2018

(54) DIODE ACCOMMODATION CORE

(71) Applicant: Robert Bosch Motores De Partida E Alternadores Ltda, Itupeva (BR)

(72) Inventor: Breno Raizer, Campinas (BR)

(73) Assignee: Robert Bosch Motores De Partida E Alternadores Ltda., Itupeva (BR)

( * ) Notice: Subject to any disclaimer, the term of this patent is extended or adjusted under 35 U.S.C. 154(b) by 0 days.

(21) Appl. No.: 15/108,049

(22) PCT Filed: Dec. 26, 2014

(86) PCT No.: PCT/BR2014/000454

§ 371 (c)(1),
(2) Date: Jun. 24, 2016

(87) PCT Pub. No.: WO2015/095944

PCT Pub. Date: Jul. 2, 2015

(65) Prior Publication Data

US 2016/0329142 A1 Nov. 10, 2016

(30) Foreign Application Priority Data

Dec. 27, 2013 (BR) ..... 102013033677
Dec. 3, 2014 (BR) ..... 102014030289

(51) Int. Cl.
*H01F 7/00* (2006.01)
*H01F 7/08* (2006.01)
(Continued)

(52) U.S. Cl.
CPC ..... *H01F 7/08* (2013.01); *F02N 11/0859* (2013.01); *F02N 15/006* (2013.01); *F02N 15/10* (2013.01);
(Continued)

(58) Field of Classification Search
CPC ..... H01F 7/08; F02N 11/0859
(Continued)

(56) References Cited

U.S. PATENT DOCUMENTS 4,117,821 A * 10/1978 Kawai ..... F02N 11/0851 123/179.16
4,169,450 A * 10/1979 Tanaka ..... B60H 1/3208 123/198 D
(Continued)

FOREIGN PATENT DOCUMENTS

JP 2008166649 A 7/2008
JP 2008196373 A 8/2008

*Primary Examiner* — Shawki S Ismail
*Assistant Examiner* — Lisa Homza
(74) *Attorney, Agent, or Firm* — Harrington & Smith

(57) ABSTRACT

A diode accommodation core, for use in solenoids of starter engines and accommodation of the diodes in these solenoids without thereby affect the structural configuration of the diodes or the structures of starter engines. The diode accommodation core includes a structural body having opening for the accommodation of body of diode, and two contact sides opposite each other, wherein each side is provided with accommodation guide of the respective terminals of the diode, which has a surface portion in which at least one of the terminals is supported and at least partially exposed regarding the surface of the corresponding contact side of structural body, in order to promote electrical contact with at least one adjacent component by pressure.

16 Claims, 7 Drawing Sheets

(51) Int. Cl.

| | |
|---|---|
| ***F02N 15/00*** | (2006.01) |
| ***F02N 15/10*** | (2006.01) |
| *F02N 11/00* | (2006.01) |
| *F02N 11/08* | (2006.01) |
| *F02N 11/10* | (2006.01) |
| *F02N 15/02* | (2006.01) |
| *F02N 15/06* | (2006.01) |

(52) U.S. Cl.
CPC ..... *F02N 11/00* (2013.01); *F02N 11/0862* (2013.01); *F02N 11/10* (2013.01); *F02N 15/02* (2013.01); *F02N 15/067* (2013.01); *F02N 2011/0881* (2013.01)

(58) Field of Classification Search
USPC ..... 335/220
See application file for complete search history.

(56) References Cited

U.S. PATENT DOCUMENTS 4,432,446 A * 2/1984 Okano ..... F16D 27/112 192/84.941
5,812,044 A * 9/1998 Sakamoto ..... F16D 27/112 192/84.1
5,927,240 A * 7/1999 Maxon ..... B60R 25/04 123/179.25
6,148,781 A 11/2000 Boegner et al. ..... 123/179.3
8,590,500 B2 * 11/2013 Notani ..... F02N 11/0844 123/179.25
8,847,713 B2 * 9/2014 Niimi ..... F02N 11/087 335/126
2004/0055554 A1 * 3/2004 Tharman ..... F02D 41/067 123/179.18
2004/0129041 A1 * 7/2004 Shigeyama ..... B60R 25/02126 70/239
2007/0227470 A1 * 10/2007 Cole ..... H02K 1/2786 123/3
2012/0105179 A1 5/2012 Kurasawa ..... 335/185
2012/0330538 A1 * 12/2012 Spjuth ..... F02N 11/0866 701/113
2013/0062891 A1 * 3/2013 Bourbeau ..... F02N 11/0851 290/38 C
2013/0125850 A1 * 5/2013 Liu ..... F02N 11/0814 123/179.3
2014/0238343 A1 * 8/2014 Groh ..... F02N 19/00 123/319
2014/0299089 A1 * 10/2014 Koenen ..... F04B 17/05 123/179.28
2016/0115933 A1 * 4/2016 Koenen ..... B60T 7/042 290/38 R
2016/0273467 A1 * 9/2016 Kawano ..... F02M 35/10216

* cited by examiner

DIODE ACCOMMODATION CORE

FIELD OF THE INVENTION

The present invention relates to a diode accommodation core, particularly developed for use in solenoid of starter engines used in automotive vehicles. More preferably, the diode accommodation core, object of the present invention, comprises technical, constructive and functional aspects totally innovative and that are able to get a simple, practical, and highly efficient solution regarding the installation and accommodation of the diodes in the solenoids without thereby affect the structural configuration of the diodes or the structures of starter engines.

BACKGROUND OF THE INVENTION

According to the prior art, and as should be within the common knowledge among the skilled ones in the art, starter engines, also called starters, are formed by a structure comprised basically of a cooperating solenoid with an actuating lever which in turn moves the sprocket or freewheel to connect to the crankshaft of the combustion engine. The actuation of these mechanisms occurs through the power supply from the moment the automotive vehicle's driver rotates the key, triggers the start button on the vehicle dashboard or the vehicle's ECU activates the actuation.

More particularly, at the time of starting the engine combustion of automotive vehicles, the solenoid receives an electrical signal through the engine driving terminal thereof, which is also called "borne#50", in order to trigger the coils of said solenoid and, thus, generate a magnetic field that pulls the solenoid armature, dragging the driving lever of the starter engine. At this time, said actuating lever pushes the sprocket or freewheel to connect in the crankshaft gear and at the same time, the solenoid closes the electrical contact of the main circuit and starts to energize the coil and armature of the starter engine, producing a magnetic field and consequently the engine rotational motion with enough torque and speed so that the crankshaft can drive the combustion engine.

From the moment the combustion engine can move alone, the electrical signal applied to borne#50 of the solenoid can be stopped and, with it, the coils are no longer energized and the sprocket or freewheel is, then disengaged from the crankshaft gear, usually through the action of a spring arranged to ensure that decoupling.

Some time ago it was noticed that at the time the electrical signal at said borne #50 was stopped, electrical pulses were generated due to the inductance properties of the solenoid's coils, these electrical pulses being harmful to the electrical system of automotive vehicles, affecting the operation of the equipment and electrical and electronic components.

Thus, in order to solve and/or minimize these drawbacks related to the electrical pulses, the starter engine manufacturers began to install a voltage suppressor diode with the solenoid, particularly in a parallel connection with the coils, in order to limit said electrical pulses in more acceptable values and levels to reduce risks and damage to the electrical system of the automotive vehicle.

Thus, it is known in the art a variety of ways for inserting, positioning and installing the suppressor diode with the structure of the solenoid, which must necessarily be connected in one side to the borne #50 and in the other side with an electrical ground reference which may be, for example, the housing or the magnetic core of the solenoid.

One of the ways known in the prior art consists of providing brackets welded to the terminals of the diodes, which are used to fixture and contact with the respective electrical contacts of the solenoid. This solution does not seem practical and simple, since it is necessary to weld the diodes terminals together with said brackets and then insert and install them in the solenoid structure, what hamper the assembly process as well as increasing the costs involved. An example of this solution can be seen in document JP2008196373, which discloses a diode accommodation core comprising two terminals which are welded or terminated in"knife" in places where the diode thread is embedded, being thus constituted by three components collaborating with a resin cover.

Another solution available in the prior art comprises a combination of welding and locking by crimping the diode terminals with the solenoid structure. More specifically, this way of inserting and installing said diode consists of crimping one of the diode terminals with the male bracket of borne #50, and the other terminal is welded in the magnetic core of the solenoid. It is noted that, although functional until the present days, this solution still shows a bit complicated and can be improved and/or optimized, in particular as to the manufacturing process to ensure proper positioning of the respective electrical contacts.

Additionally, it is also known in the state of the art solutions in which the welds are eliminated, preserving only the locking by crimping of the diode terminals with the respective contacts, that is, folding and crimping the diode terminals on borne #50 and the magnetic core of the solenoid. However, it is noted that this process is very complex and quite difficult to be realized in the practice, since, as should be appreciated by those skilled in the art, there is no space available on the solenoid structure for handling and crimping of the diode terminals and consequently, there is a great difficulty in obtaining the correct and secure positioning of this diode, without risk of release.

Thus, as can be seen, the ways known in the state of the art for application and installation of suppressor diodes on solenoids of starter engines disclose relatively complex solutions, require additional structural elements or substantial adjustments in the structure of the solenoid as a whole. Further, it is noted that these solutions can even result in damage to other components of the solenoid, or the starter engine itself, due to the difficulty and complexity of the insertion and installation process of these diodes.

More particularly, it is confirmed that the solutions proposed and known until the present days use welds or locking by crimping, said means can affect and damage the diodes and the solenoid. In a clear manner, the welding process is relatively dangerous to the diodes, given that the high temperatures required to promote the weld can damage the inner structure of the diodes. However, the locking by crimping process requires additional components and parts to support and lock the terminals and also to use as connectors of the diodes.

It should be noted, therefore, that both forms of attachment and installation of the diodes face serious difficulties due to the space available for handling the involved elements and, as a consequence, they sacrifice the fixture quality and the contact level required to reduce and/or eliminate the problems generated by electrical pulses coming from the energizing and de-energizing of the starter engine coils.

Thus, before all the above reported, it can be noted that the means for insertion and installation of suppressor diodes in starter engines for automotive vehicles known in the prior art have problems, inconveniences and restrictions for proper accommodation of the diode, as well as regarding the safe arrangement of the terminals thereof. More specifically, it is noted that the current state of the art lacks solutions able to effectively eliminate the use of weld-type harmful media as well as additional components and elements to promote the locking by crimping.

Objectives of the Invention

It is therefore an object of the present invention to provide a diode accommodation core, particularly for use in solenoids of starter engines used in automotive vehicles, being comprised of technical, structural and functional features specially developed to solve, in a simple, efficient and economical manner, the limitations and drawbacks disclosed by the various forms known in the diodes insertion and installation technique in solenoids of starter engines.

More preferably, it is an object of the present invention to provide a diode accommodation core whose characteristics have been designed to further simplify the diodes insertion and installation process with the solenoids structures, eliminating to the maximum extent the need to use locking by crimping, and especially the use of welds.

It is also one of the objectives of the present invention to provide a diode accommodation core which allows to use the geometries and the spaces currently available in the structural components of the solenoid, thus avoiding the need for adjustments and/or modifications that may somehow affect the production lines of the starter engines.

It is yet another among the objectives of the present invention to provide a diode accommodation core, which configuration allows to position in a safe and appropriate manner the diode contact terminals, isolating them from each other, and ensuring that each terminal stay in touch, respectively, with the fixture screw of borne #50, and with the electrical ground reference.

The diode accommodation core object of the present invention is yet intended to also eliminate the need for processes that lead to high manufacturing costs, for example crimping, machining, welding, or other similar manufacturing processes, which ultimately compromise the production lines and the solenoid assembly to starter engines.

Therefore, in summary, it is possible to say that one of the main objectives of the present invention is to propose a diode accommodation core, especially for solenoids of starter engines, consisting of technical aspects developed to facilitate the manufacturing and assembly process of the solenoids, but mainly to ensure the positioning of the terminals by conducting electrical connection by pressure, without requiring adjustments in the geometric structure of the solenoids currently available on the market, or the obligatory use of welding and/or assembly additional processes.

SUMMARY OF THE INVENTION

Thus, in order to achieve the objectives and technical effects stated above, the present invention relates to a core for diode accommodation, especially for solenoids of starter engines, being comprised of a structural body having an opening where the body of the diode can be accommodated, and also has two contact sides which are opposite to each other, and each of them is provided with accommodation guide of the respective terminals of the diode, which has a surface portion in which at least one of said terminals is supported and at least partially exposed in relation to the surface of the corresponding contact side of the structural body, so as to promote the electrical contact with at least one adjacent component by pressure.

Optionally, the object of the present invention comprises a terminal supported and at least partially exposed to the surface of the corresponding contact side of the structural chorus, while the other terminal is crimped to the surface of the corresponding contact side of the structural body, or connected to the same by interference or other appropriate means; alternatively both terminals may remain supported and at least partially exposed regarding the surface of the corresponding contact side of the structural body.

More preferably, each of the accommodation guides extends from said opening and they are formed by an upward portion which is inclined toward the surface of the respective contact side, and by said surface portion.

Optionally, according to a variant embodiment of the present invention in which the diode can be positioned at an angle in said opening, the diode accommodation core comprises accommodating tabs extending from said opening, and which are formed only by a surface portion arranged on the surface of the corresponding contact side of the structural body.

According to a possible embodiment of the present invention, said structural body of the diode accommodation core comprises a tablet shape.

Preferably, the opening provided in the structural body of the diode accommodation core according to the present invention has slits for the passage of the diode contact terminals, said slots being in communication with said accommodation guide arranged in each contact side of the structural body.

According to preferred embodiments of the present invention, said structural body of the diode accommodation core is manufactured in a flexible and insulating material. More preferably, it can be manufactured in a material selected from rubber, silicone, plastics and other insulating polymers. In particular, attention is drawn to the fact that at least the surface of the contact sides of the structural body must be covered with an insulating material.

Optionally, and in accordance with the solenoid model used, said structural body may comprise at least one locking portion whose purpose is to promote fitting into respective openings or slots already provided in the solenoid cover. More advantageously, with regard to fixing and adhesion, said locking portions are provided with ribs.

Additionally, according to advantageous embodiment of the present invention, the surface portions of the accommodating guides of the structural body comprise a channel profile to ensure proper positioning of the diode terminals.

Further, according to one advantageous embodiment preferably nowadays, said structural body of the diode accommodation core according to the present invention, comprises a shape corresponding to the screw head shape, more preferably, comprises an hexagonal shape.

Finally, according to other possible embodiments of the diode accommodating core of the present invention, said opening may be positioned in the center of the structural body, or optionally in an asymmetric or decentralized manner.

BRIEF DESCRIPTION OF THE DRAWINGS

The features, advantages and technical effects of the present invention, as outlined above, will be best understood by one skilled in the art from the following detailed description, made merely by way of example, and not limitation, of preferred embodiments, and with reference to the appended schematic figures, which.

DETAILED DESCRIPTION OF THE INVENTION

According to the schematic figure indicated above, some examples of possible and preferred embodiments of the present invention will be described in more detail below, but it should be clear that this is a purely exemplary and non-limiting description, since this diode accommodation core can have different details and structural and dimensional aspects without thereby being out of the scope of protection.

Additionally, it is noteworthy that some references indicative of the features of the present invention will not be fully reproduced in all the above mentioned figures, considering that the reproduction of all references in all the figures could affect the understanding and definition of the present scope of protection.

accordance with the accompanying drawings, particularly with reference to FIGS. 1, 2A, 2B and 2C, it is seen that the diode accommodation core object of the present invention is preferably applied to starter engines (M), which are made of a structure comprising essentially a solenoid (S) which cooperates with a driving lever (A) which, in turn, moves the sprocket or freewheel (R) for connection to the combustion engine. The actuation and operation of these components is well known to those skilled in the art and was also briefly noted above, reason for which it is believed that it is unnecessary to go into detail again.

In this regard, it is noted that said solenoid (S) comprises a cover (T) where the bornes of electrical contact are positioned, including borne #50 (B) that is fixed with the body of the cover (T) through screw (P).

Figure 1:
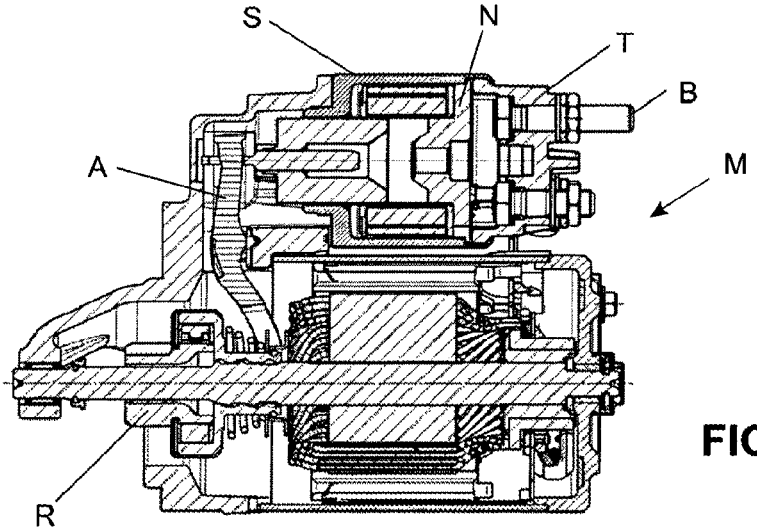
FIG. 1 illustrates a sectional view of a conventional starter engine for automotive vehicles.
Figure 2A:
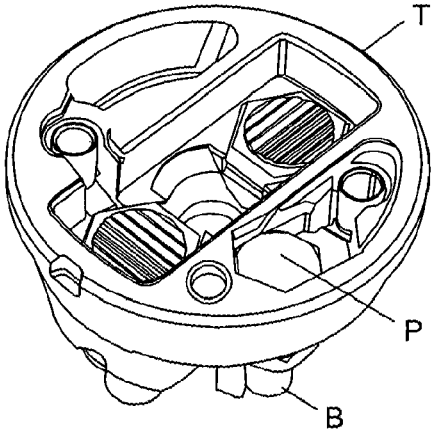
FIG. 2A illustrates a perspective view of the solenoid cover of a starter engine, as shown in FIG. 1.
Figure 2B:
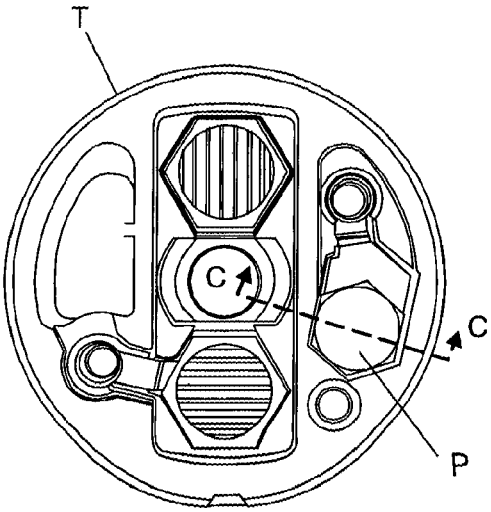
FIG. 2B illustrates a top view of the solenoid cover as shown in FIG. 2A.
Figure 2C:
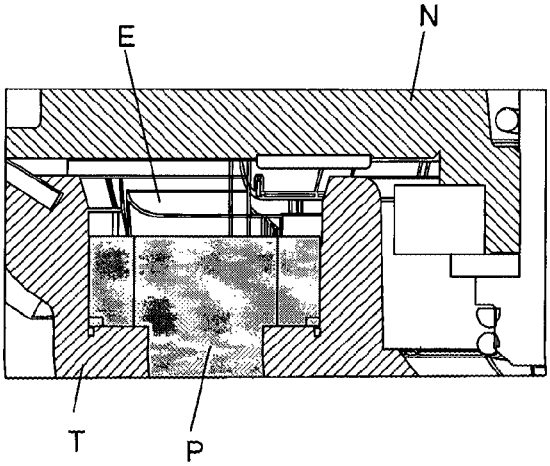
FIG. 2C illustrates an enlarged sectional view according to the lines C-C shown in solenoid cover illustrated in FIG. 2B.

Additionally, it is noted that said cover (T) is fitted with the solenoid body (S) in order to press the magnetic core (N), forming between the screw head (P) and said magnetic core (N) a space (E) which is currently totally free of any material. FIG. 2C shows more clearly that space (E) between the screw head (P) and the surface of the magnetic core (N), the diode accommodation core object of the present invention is preferably inserted and positioned in this space (E).

Figure 3:
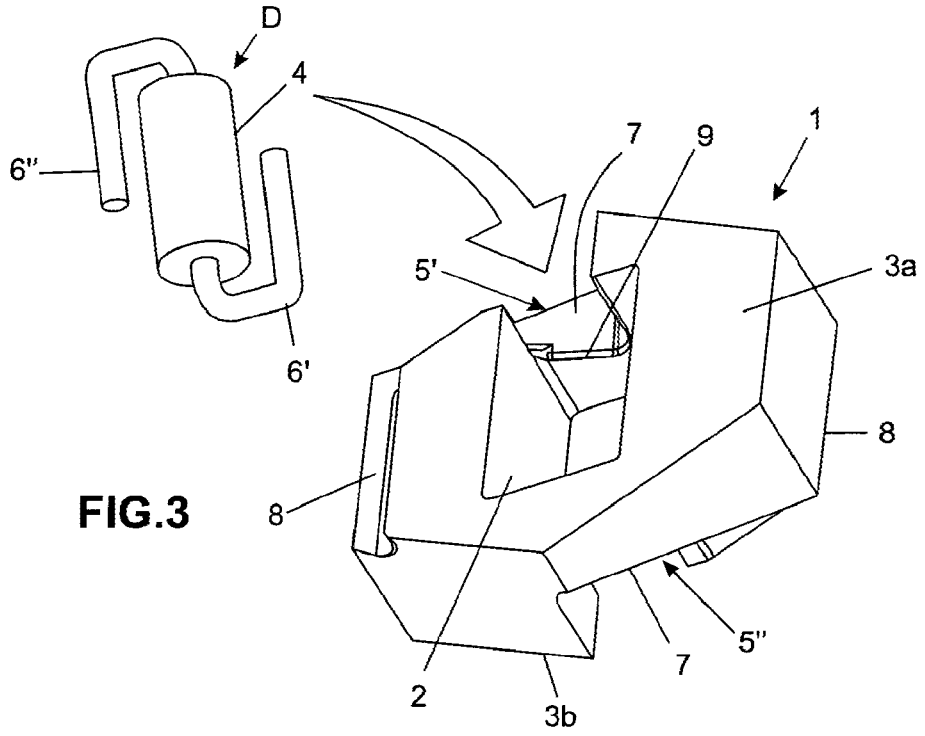
FIG. 3 illustrates an exploded perspective view of the diode accommodation core according to the present invention, with the suppressor diode uncoupled.
Figure 4A:
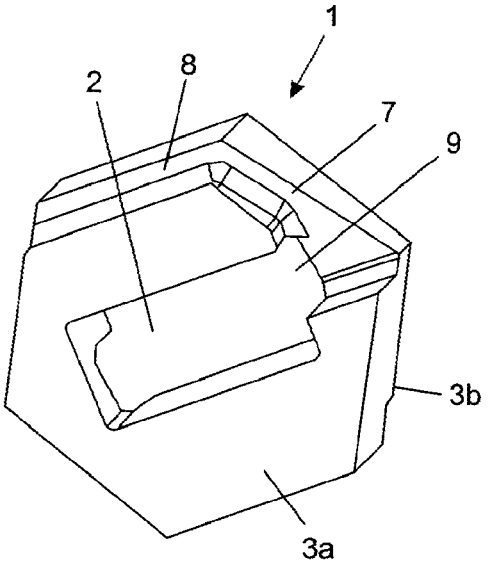
FIGS. 4A and 4B illustrate perspective views of the diode accommodation core object of the present invention in different viewing angles.
Figure 4B:
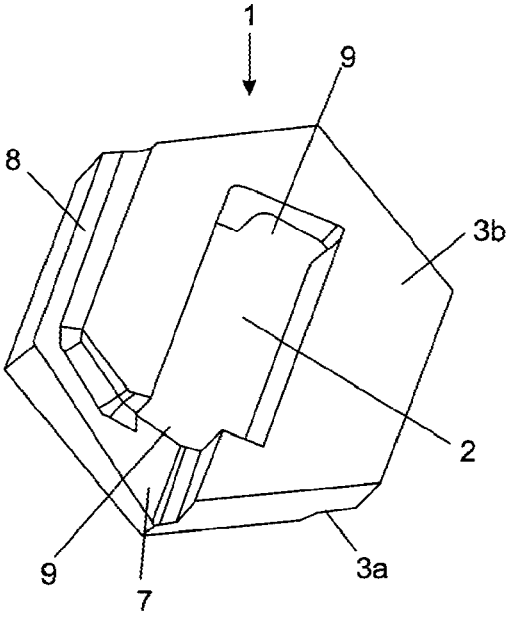

Thus, referring now to the other figures, and particularly to FIGS. 3, 4A and 4B, it is noted that the diode accommodation core according to the present invention comprises a structural body 1, preferably in tablet form, provided with opening 2 for accommodating the body 4 of the diode (D) and two contact sides 3*a* and 3*b* opposing each other, each provided with accommodation guide 5', 5" of the respective terminal 6', 6" of diode (D).

More specifically, each accommodation guide 5', 5" extends from said opening 2, and can be formed by an rising portion 7, which is inclined toward the surface of the respective contact side 3*a* or 3*b*, and a surface portion 8 in which said terminal 6', 6" is supported and at least partially exposed regarding the surface of the corresponding contact side 3*a* or 3*b* of the structural body 1. This configuration of the accommodation guides 5' 5" is preferred in the case of the diode (D) be horizontally accommodated in the opening 2, i.e. parallel to said contact sides 3*a* and 3*b* in order to promote electrical contact with at least one adjacent component by pressure, and therefore, without requiring the welding of components. Note that such a construction discloses a single part capable of promoting pressure connection, significantly in a more simple, practical and efficient manner than that achieved with the use of similar known ones.

It should be noted that although the preferred embodiment illustrated in the appended figures shows that in both terminals 6', 6" the electrical contact is made by pressing of the components, it is possible that only one terminal 6' acts under pressure and the complementary terminal 6" acts by crimping, or vice versa, without thereby standing out of the scope of protection required here. Alternatively, it is possible to perform the electrical contact of the complementary terminal by interference assembly or other suitable technique available.

Figure 5A:
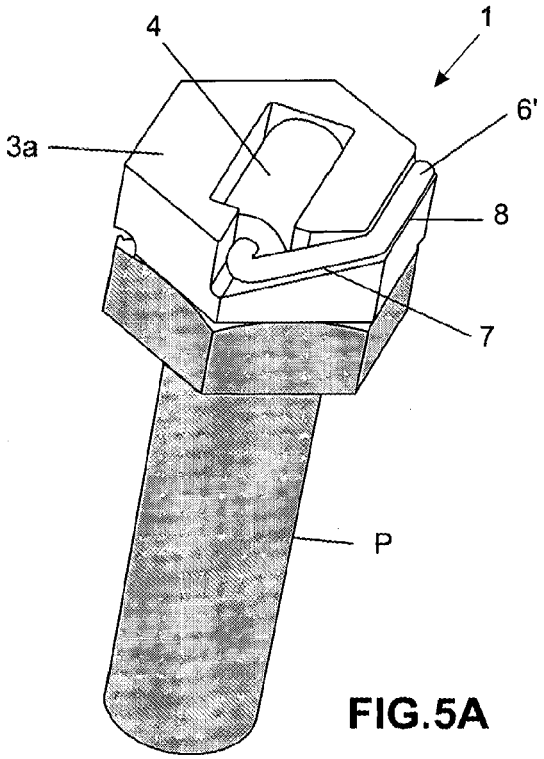
FIG. 5A shows a perspective view of the diode accommodation core according to the present invention, positioned on the fixture screw of borne #50 of the solenoid.
Figure 5B:
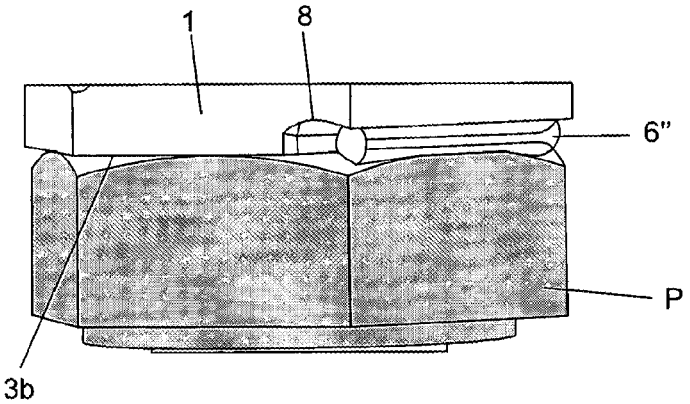
FIG. 5B shows an enlarged view of the detail of the diode contact terminal touching the surface of the fixture screw of borne #50 according to the present invention.
Figure 5C:
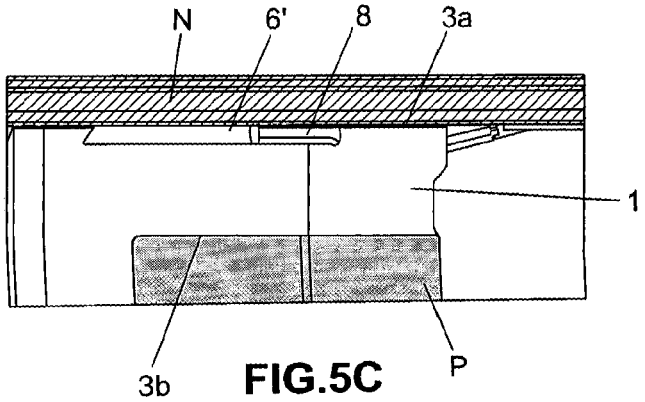
FIG. 5C shows another enlarged view of the detail of the other diode contact terminal touching the surface of the magnetic core of the solenoid according to the present invention.

FIGS. 5A, 5B and 5C show in more detail the configuration and arrangement of said diode (D) properly embedded and accommodated in the diode accommodation core object of the present invention. More particularly, it can be seen that body 4 of the diode (D) is accommodated in opening 2 of structural body 1, and the respective contact terminals 6', 6" are folded and rested on respective accommodation guides 5', 5" of each contact side 3*a* and 3*b* of structural body 1. As can be seen, by this arrangement it is possible to ensure that said contact terminals 6', 6" remain separated and primarily isolated from one another, each contact terminal 6', 6" is positioned in one of said contact sides 3*a*, 3*b* of structural body 1.

Although the accompanying drawings illustrate configurations in which the accommodation guides 5', 5" comprise said rising portion 7, alternatively, and depending on the space (E) available in the cover (T), said diode (D) could be positioned in opening 2 at an angle so that, in this condition, it is even possible to eliminate rising portion 7, said terminals 6', 6" already being in the level of said surface portion 8 and thus providing proper electrical contact with screw head (P) and the magnetic core (N).

At the time that said cover (T) is positioned with the body of solenoid (S), an axial pressure occurs by interference to ensure the electrical connection of diode (D) with screw (P) and magnetic core (N).

Particularly with respect to FIG. 5B, it is noted that the contact terminal 6" is positioned on the accommodation guide 5" provided in said side 3*b* of the structural body 1, therewith, when the diode is allocated in the accommodation core, and side 3*b* positioned adjacent/on the head of screw (P), it is ensured that there will be contact between the head of screw (P) and diode (D) due to the terminal portion (6") be accommodated in the surface portion (8). Opposite, as illustrated in FIG. 5C, terminal contact 6' is positioned on accommodation guide 5' provided in side 3*a* of structural body 1 so that, when the diode is allocated in the accommodation core, and side 3*a* positioned adjacent to magnetic core (N), it can ensure contact between magnetic core (N) and diode (D) due to terminal portion (6') be accommodated in surface portion (8) of contact side 3*a*. Thus, by this arrangement, it is possible to close the connection of diode (D) with borne #50 and said electrical ground reference, in this case magnetic core (N), without the need for any soldering or crimping process.

Figure 6A:
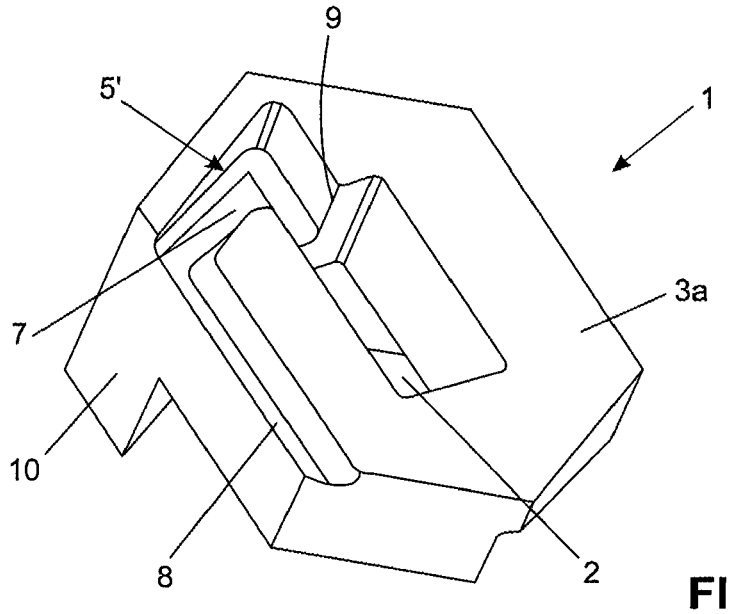
FIGS. 6A and 6B show perspective views, from opposite sides, of a constructive embodiment of the diode accommodation core object of the present invention.
Figure 6B:
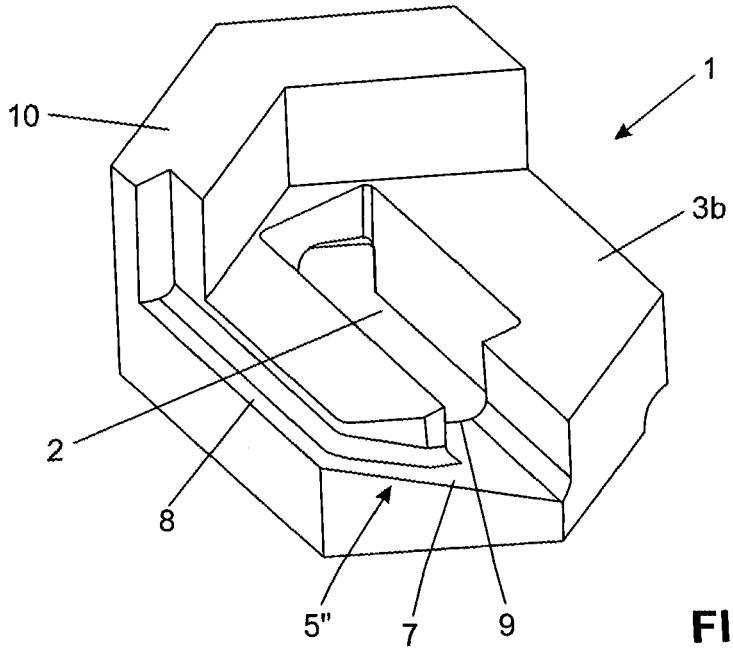
Figure 7A:
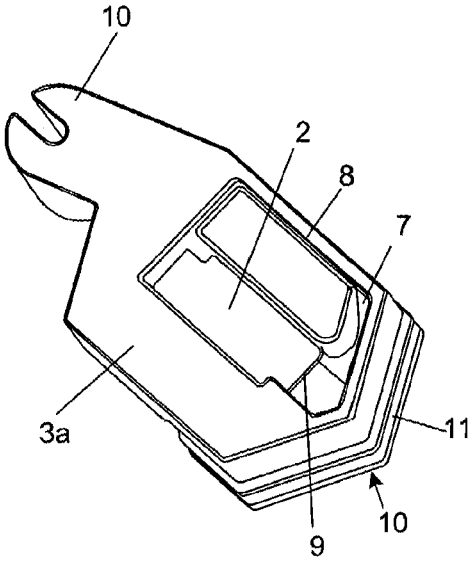
FIGS. 7A and 7B illustrate perspective views of another constructive embodiment of the diode accommodation core according to the present invention, with and without the suppressor diode, respectively.
Figure 7B:
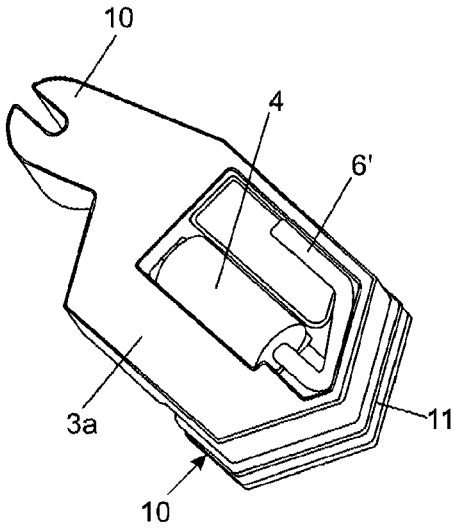
Figure 8A:
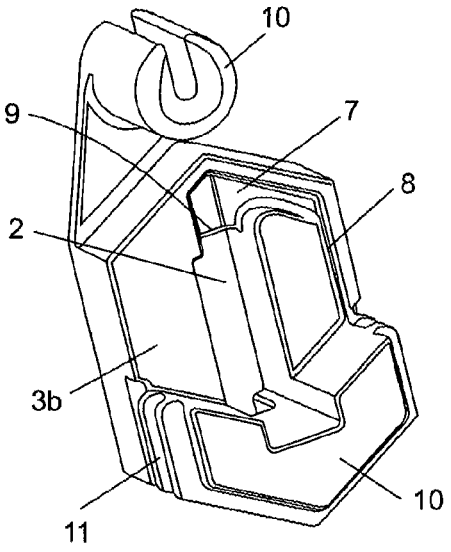
FIGS. 8A and 8B illustrate perspective views of opposite sides to those illustrated in FIGS. 7A and 7B, of the diode accommodation core according to the present invention, with and without the suppressor diode, respectively.
Figure 8B:
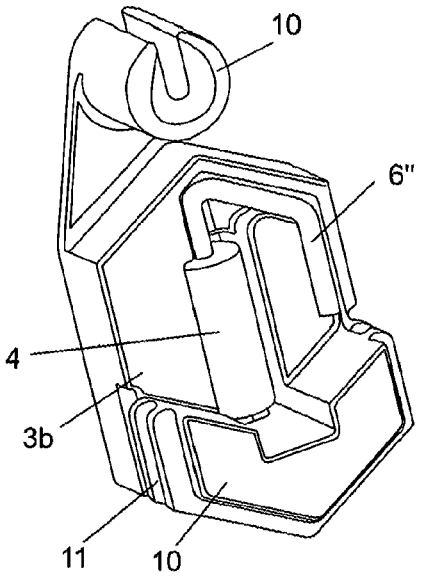
Figure 9:
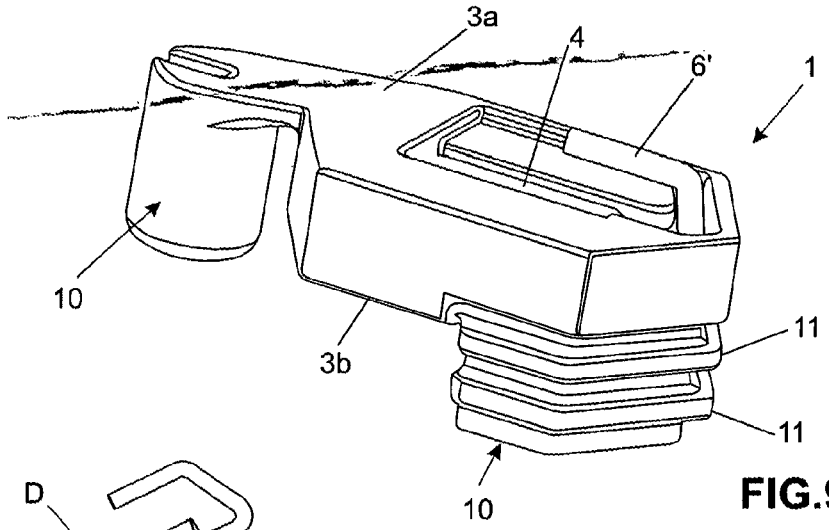
FIG. 9 shows a perspective view of another possible embodiment of the diode accommodation core, according to the present invention.
Figure 10A:
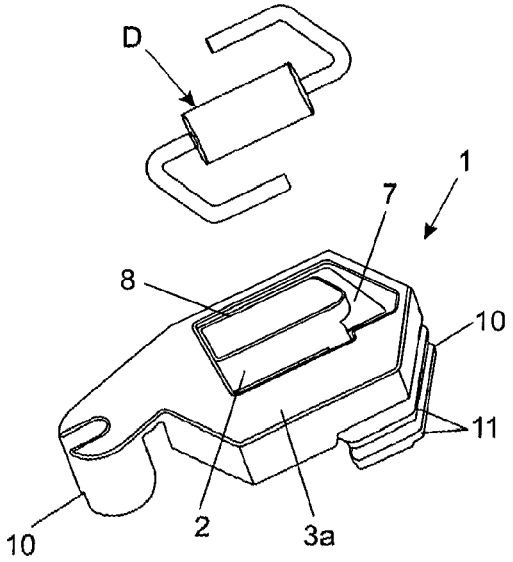
FIG. 10A illustrates a perspective view of the diode accommodation core perspective according to the invention, with said diode uncoupled.
Figure 10B:
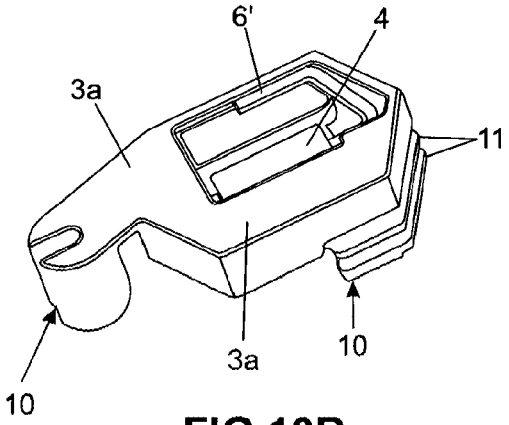
FIG. 10B illustrates a perspective view of the diode accommodation core similar to FIG. 10A, but with said diode coupled.
Figure 11A:
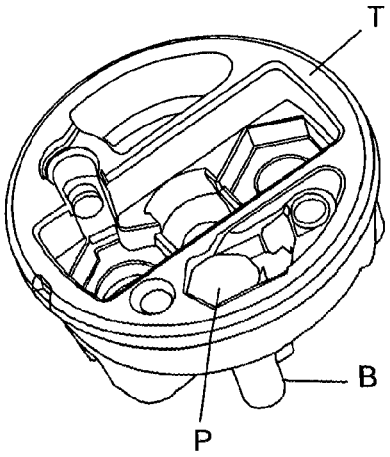
FIGS. 11A and 11B illustrate perspective views of a solenoid cover according to the present invention with and without the diode accommodation core, respectively.
Figure 11B:
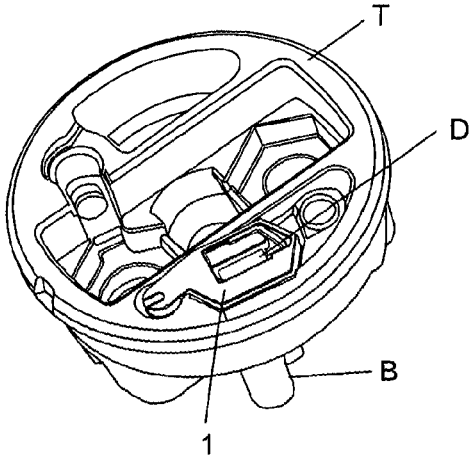

Referring to FIGS. 6A and 6B, it can be seen in a somewhat more detailed manner the diode accommodation core, more specifically structural body 1, that is comprised by opening 2 for receiving body 4 of diode (D), wherein said opening 2 has slits 9 for the passage of contact terminals 6', 6" of the diode (D), to enable folding and support of these terminals on accommodation guides 5', 5", particularly, positioning such terminals 6', 6' on rising portions 7 and, in sequence, on surface portions 8.

According to a preferred embodiment of the present invention, said structural body 1 of the diode accommodation core is manufactured in a flexible and insulating material, and which is mainly susceptible to partial deshapeion when subjected to pressure when coupling the cover (T) in the body of the solenoid (S). Most preferably, this material may be selected from rubber, silicone, plastics and other insulating polymers. More particularly, it should be clear that at least the surface of the contact sides 3*a* and 3*b* should be coated or consists of an insulating material.

The structural body 1 of the diode accommodating core according to the present invention may also comprise a locking portion 10 whose purpose is to penetrate and fit into openings or grooves provided in the cover (T) of the solenoid (S). Of course, as it should be appreciated by those skilled in the art, this locking portion 10 can comprise different arrangements, since it should correspond to the formed and geometrical characteristics of cover (T). Optionally, this locking portion 10 can comprise ribs 11 which enhance the flexibility, but improve the adhesion with the surface of the cover (T).

FIGS. 7A, 7B, 8A, 8B, 9, 10A, 10B, 11A, 11B show in more detail the characteristics of the diode accommodation core, according to a possible embodiment of the present invention, in which case the structural body 1 comprises two locking portions 10, one smooth and the other with a series of ribs 11 to ensure the perfect fit and keep the same with the cover. It is noted that the geometrical arrangement of this embodiment is designed to meet the shape and configuration of cover (T) of solenoid (S), in which there is provision for a hole and space around the head of screw (P) of borne #50 (B).

Figure 12:
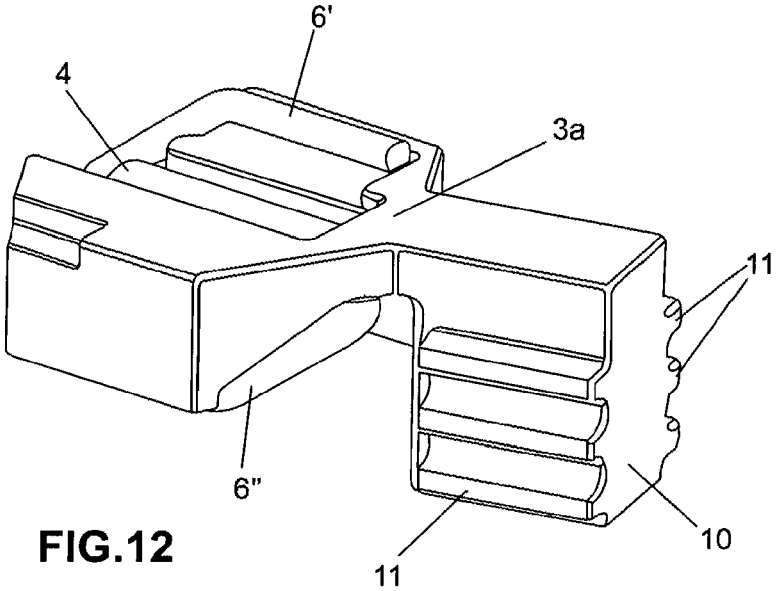
FIG. 12 shows a perspective view of another alternative embodiment of the diode accommodation core according to the present invention.
Figure 13A:
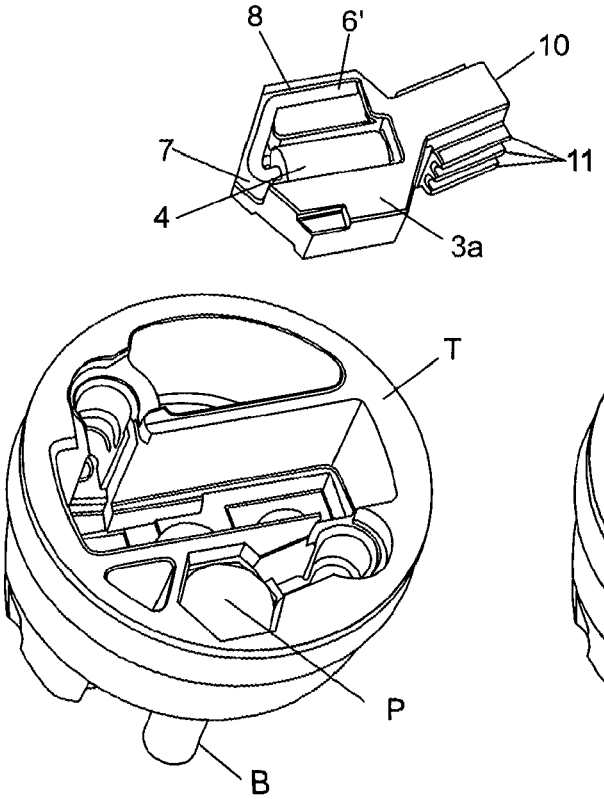
FIGS. 13A and 13B illustrate perspective views of a solenoid cover according to the present invention without and with the coupled diode accommodation core, respectively.
Figure 13B:
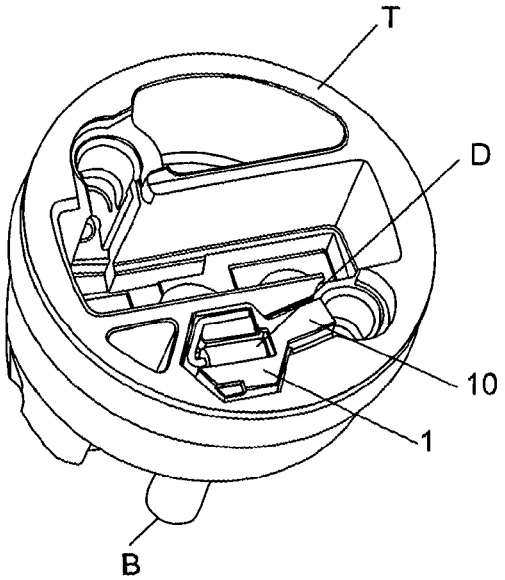

FIGS. 12, 13A and 13B show another constructive embodiment of structural body 1 of the diode accommodation core according to the present invention. More particularly, in this case, it appears that there is only one locking portion 10, which is provided with a series of ribs 11 to promote proper adhesion of structural body 1 with cover (T). Further, it is noted that said cap (T) comprises a region whose geometry corresponds to locking portion 10, allowing the frame body 1 with the diode thereof (D) to be embedded in cover (T) without occupying or disrupting the operation of other components of solenoid (S).

As a rule, as should be noted, the geometric configuration of structural body 1 and the possible locking portions 10 thereof are designed to meet the needs and settings of each solenoid model, and more particularly to each model of cover (T) of solenoids (S).

According to one preferably advantageous embodiment, and as can be seen in some of the attached figures, said surface portions 8 of accommodation guides 5', 5" may comprise a channel profile, in order to ensure the positioning of contact terminals 6', 6" of diode (D), thereby avoiding any risk of diode (D) to move and provide eventual contact failures.

Also, according to other preferred embodiments of the present invention, said structural body 1 comprises a hexagonal shape, since the vast majority of the solenoid models known in the current market has a borne #50 fixed by a standard screw of hexagonal head type—M6, and thus it is possible to accommodate said core in space (E) generated between screw (P) and magnetic core (C) of solenoid (S). Therefore, the shape of structural body 1 depends on the solution used in the cover of solenoid (S) which provides space (E) between the connection of borne #50 and magnetic core (N), not being necessarily hexagonal.

Further, attention is drawn to the fact that although the illustrative figures present a second opening 2 relatively disposed in the center of structural body 1, the present invention should not be limited and restricted to this condition, since it is possible to arrange said opening 2 in an asymmetric or decentralized manner.

According to the above, it becomes possible to verify that the diode accommodation core, according to the possible embodiments of the present invention, is able to promote a series of advantages and technical, practical and functional benefits, eliminating processes steps which are complex, expensive and difficult to perform. In addition, it becomes possible to ensure proper positioning of terminals 6', 6" of diode (D) in relation to borne #50 (B) through the head of screw (P) and said electrical ground reference, in this case the magnetic core (C) of solenoid (S).

This proper positioning and connection are also possible due to the fact that terminals 6', 6" of diode (D) are separated and insulated from each other without providing any risk of contact between them and hence it is eliminated eventual risk of failure in the operation of the diode and, as a result, one can reduce the problems and inconveniences generated by the electrical pulses generated by the energizing and de-energizing the solenoid coils. More particularly, it becomes clear that the diode accommodation core object of the present invention can achieve as a practical results the proper support of diode (D), and at the same time, ensures that the terminals of said diode (D) are pressed against the contact of borne #50 and the electrical ground reference, more preferably, through contact with the head of screw (P) and magnetic core (N) of solenoid (S).

Finally, considering all the above, it is important to note that the present disclosure is solely intended to describe in an exemplificative manner the preferred embodiments of the diode accommodation core for starters engines, according to the instant invention. So, as well comprised by the skilled technician in the art, numerous constructive modifications, variations and combinations of the elements performing the same function in substantially the same way are possible to achieve the same results, which should be included within the scope of protection defined by the appended claims.

The invention claimed is:

1. Starter engine solenoid comprising a cover, a magnetic core, a diode and a diode accommodation core, CHARACTERIZED in that said diode accommodation core is positioned in a space defined between the cover and the magnetic core and said diode accommodation core comprises a structural body being manufactured in a flexible and insulating material, said structural body provided with:

an opening of accommodation of body of the diode;

two contact sides opposite to each other, wherein each contact side is provided with accommodation guide of terminals of the diode;

each accommodation guide comprising a surface portion in which at least one of said terminals is supported and at least partially exposed to the surface of the corresponding contact side of structural body, in order to be electrically contacted with at least one adjacent component by pressing when said cover presses the diode accommodation core against the magnetic core.

2. Starter engine solenoid according to claim 1, CHARACTERIZED in that one terminal of the diode is supported and at least partially exposed regarding the surface of the corresponding contact side of structural body, and the another terminal is crimped to the surface of the corresponding contact side of structural body, or connected thereto by interference or other suitable means.

3. Starter engine solenoid, according to claim 1, CHARACTERIZED in that the two terminals of the diode are supported and at least partially exposed regarding the surface of the corresponding contact side of structural body.

4. Starter engine solenoid, according to claim 1, characterized in that each accommodation guide extends from said opening, and is formed by a rising portion, inclined toward the surface of the respective contact side, and said surface portion.

5. Starter engine solenoid, according to claim 1, CHARACTERIZED in that each accommodation guide extends from said opening and is formed only by a surface portion arranged in the surface of the corresponding contact side of structural body.

6. Starter engine solenoid, according to claim 1, CHARACTERIZED in that said structural body comprises a tablet shape.

7. Starter engine solenoid, according to claim 1, CHARACTERIZED in that said opening has slots for the passage of contact terminals of diode.

8. Starter engine solenoid, according to claim 1, CHARACTERIZED in that said structural body is manufactured in a material selected from rubber, silicone, plastic or other polymer.

9. Starter engine solenoid, according to claim 8, CHARACTERIZED in that said locking portion comprises ribs.

10. Starter engine solenoid, according to claim 1, CHARACTERIZED in that at least the surface of contact sides of structural body must be coated with or consists of an insulating material.

11. Starter engine solenoid, according to claim 1, CHARACTERIZED in that said structural body comprises at least one locking portion for engagement in openings or slots provided on cover of solenoid.

12. Starter engine solenoid, according to claim 1, CHARACTERIZED in that said surface portions of the accommodation guides comprise a channel profile.

13. Starter engine solenoid, according to claim 1, CHARACTERIZED in that said structural body comprises a shape corresponding to the shape of the head of screw.

14. Starter engine solenoid, according to claim 1, CHARACTERIZED in that said structural body comprises a hexagonal shape.

15. Starter engine solenoid, according to claim 1, CHARACTERIZED in that said opening is positioned at the center of structural body.

16. Starter engine solenoid, according to claim 1, CHARACTERIZED in that said opening is positioned in an asymmetrical or decentralized manner in structural body.

* * * * *